US009393168B2

(12) United States Patent
Konda

(10) Patent No.: US 9,393,168 B2
(45) Date of Patent: Jul. 19, 2016

(54) TRANSFER BELT MECHANISM ASSOCIATED WITH PATIENT TRANSFER GURNEY SYSTEM

(76) Inventor: Vishweshwar Reddy Konda, Hyderabad (IN)

( * ) Notice: Subject to any disclaimer, the term of this patent is extended or adjusted under 35 U.S.C. 154(b) by 29 days.

(21) Appl. No.: 13/180,640

(22) Filed: Jul. 12, 2011

(65) Prior Publication Data

US 2012/0291196 A1 Nov. 22, 2012

(30) Foreign Application Priority Data

May 18, 2011 (IN) ..... 1700/CHE/2011

(51) Int. Cl.

| | |
|---|---|
| ***A61G 1/003*** | (2006.01) |
| ***A61G 7/00*** | (2006.01) |
| ***A61G 7/10*** | (2006.01) |

(52) U.S. Cl.

CPC ..... *A61G 7/1019* (2013.01); *A61G 7/1032* (2013.01); *A61G 7/1046* (2013.01)

(58) Field of Classification Search

CPC ..... A61G 7/10; A61G 7/1001; A61G 7/1025; A61G 7/1026; A61G 7/103; A61G 7/1032; A61G 7/1034; A61G 7/1036; B65G 15/30

USPC ..... 198/844.1, 804

See application file for complete search history.

(56) References Cited

U.S. PATENT DOCUMENTS

| | | | | |
|---|---|---|---|---|
| 1,793,006 | A * | 2/1931 | O'Neill | 5/600 |
| 3,418,670 | A | 12/1968 | Morgan et al. | |
| 3,493,979 | A | 2/1970 | Crook et al. | |
| 3,593,351 | A * | 7/1971 | Dove | 5/88.1 |
| 3,871,036 | A * | 3/1975 | Attenburrow | 5/81.1 C |
| 3,947,902 | A * | 4/1976 | Conde et al. | 5/81.1 C |
| 4,073,016 | A * | 2/1978 | Koll | 5/81.1 C |
| 4,631,761 | A | 12/1986 | Lederman et al. | |
| 4,794,655 | A * | 1/1989 | Ooka et al. | 5/81.1 C |
| 5,185,894 | A * | 2/1993 | Bastert et al. | 5/81.1 C |
| 5,540,321 | A * | 7/1996 | Foster | 198/510.1 |
| 6,698,041 | B2 * | 3/2004 | VanSteenburg et al. | 5/81.1 R |

* cited by examiner

*Primary Examiner* — Timothy D Collins
*Assistant Examiner* — Richard G Davis
(74) *Attorney, Agent, or Firm* — Law Offices of Steven W. Weinrieb

(57) ABSTRACT

The cantilevered stretcher has a transfer belt mechanism which includes two rollers mounted on the side having two flexible non endless belts, where ends of these two flexible non-endless belts attached to one roller and the other ends of these two flexible non-endless belts attached to second roller. Further one belt goes around the stretcher and the other belt goes around the plate below the stretcher. The arrangement of flexible non endless belts moving between the stretcher and plate in same directions, with upper flexible non endless belt going around the stretcher and lower belt going around the plate can be implemented in three and four roller systems. This mechanism can load the patient onto itself in a way that is efficient and easy to operate, thereby making the patient transfer process easier. Further this mechanism is conducive to sterilization, easier to maintain.

16 Claims, 5 Drawing Sheets

TRANSFER BELT MECHANISM ASSOCIATED WITH PATIENT TRANSFER GURNEY SYSTEM

CROSS-REFERENCE TO RELATED APPLICATIONS

The present Application is based on Indian Provisional Application No. 1700/CHE/2011 filed on May 18, 2011, which in turn corresponds to Indian Application No. 848/CHE/2011 filed on Mar. 18, 2011, and priority is hereby claimed under 35 USC §119 based on these applications. Each of these applications are hereby incorporated by reference in their entirety into the present application.

TECHNICAL FIELD OF THE INVENTION

The present invention relates to the field of mechanical equipment used in hospitals for transferring patients from one location to another location. More particularly the present invention relates to the transfer belt mechanism used in trolleys, gurneys and stretchers used for transferring patients from one bed to another bed, a bed to operation theatre, a bed to x-ray table and a bed to a stretcher etc.

BACKGROUND OF THE INVENTION

A wide variety of patient transfer trolley products have been designed to move patients from one location to another and, in particular, to transfer mobility-impaired individuals. In a hospital, patients are often transferred from their beds to pre-surgery room to operation theatre to recovery room to ICU and back.

Typically, different patient transfer gurneys are used for transferring the patient from one location within the hospital to another. Therefore, when a patient is to be taken from one location to another location within the hospital, the patient must be moved from hospital ward bed to transfer gurney and transferred to the other location. In many cases 4 to 5 hospital staff physically lift the patient off the hospital ward bed and put the patient on the transfer gurney. This could be risky and uncomfortable to both the patient and the hospital staff. The process of moving the patient from the ward bed to the transfer gurney should be smooth, safe and efficient without causing injury or further damage to the patient and at the same time safe and convenient to the hospital staff transferring the patients.

Patients often have trouble moving themselves from one bed to another and from one location in a hospital/care facility to another. Further, in a hospital the nurses and the hospital staff involved in patient transfer are prone to the occupational hazard of lower back ache, which is associated with physical stress experienced while transferring patients. Invalid patients, especially those with fractures due to accidents should be handled with extreme care while being transferred. The patient should be kept as still as possible without relative movement of the limbs, neck, chest and other parts of the body, during the transfer process.

There are several Patents related to Patient Transfer Gurney systems. U.S. Pat. No. 4,631,761 issued to Ganmill limited has some drawbacks. It has one significant drawback wherein the endless transfer Belt causes a disadvantage during operation. The disadvantage is that when the top of the belt is moving in one direction, the bottom of the belt moves in the opposite direction. Therefore, while the top of the belt is trying to load the patient on to itself, the bottom of the belt will push the mattress (or sheets) on which the patient is lying on, along with the patient, away from the belt and the patient transfer trolley. This makes it difficult for loading the patient onto the patient transfer trolley.

U.S. Pat. No. 3,493,979 issued to Advanced Products Corporation of America discloses a device for transferring an object from one location to another comprises a pair of superposed endless belts mounted in a frame and adapted to be inserted between the object and its supporting surface. The device has gears, rollers and chains in the mechanisms to drive the belts. These require grease, lubrication and constant maintenance to work smoothly. Further the stretcher appears to be heavy and bulky to be handled or to be pushed or moved by the hospital staff.

U.S. Pat. No. 3,418,670 issued to Morgan et al discloses a roller stretcher with a pair of endless belt which are wound over respective upper and lower guides. A driving mechanism rotates one of the rollers so that one of the belts is moved. The belts are in frictional contact with each other whereby the non driven belt is moved by frictional contact with the driven belt. Replacement of belts is difficult and time consuming. Further, the leading edge (portion which goes under the patient) will be too thick due to the fact that there are 2 rollers on the leading edge. This thickness of the leading edge of the stretcher makes the transfer uncomfortable to patients and sometimes even painful. In case of spinal injury this transfer mechanism can further damage the patient and can even lead to fatal consequences.

U.S. Pat. No. 5,185,894 issued to Stierlen-Maquet AG discloses a patient shifting apparatus having a mobile frame supported on rollers, a cantilevered platform arranged on the frame. A transport band movable in both directions by a drive mechanism, which proceeding from a first winding roll supported by the frame, extends over the upper side of the platform, over the free longitudinal edge of the platform and along the bottom side of the platform to a second winding roll supported by the frame and onto which it is windable. Here the belt goes in zig-zag manner and bends multiple times before it goes from one roller to other roller. Therefore the torque required to move the belt is more. In this mechanism replacement of the belt, either for maintenance or for sterilization, is tedious. Further the mechanism has gears, chains, sprockets which are prone to breakdowns and have maintenance issues. The gears and chains in the mechanism may require lubrication for smooth operation and therefore not conducive to sterilization.

Hence there is a need to provide an improved mechanism for patient transfer gurney system which overcomes the problems such as, expensive to manufacture, prone to breakdowns, heavier to push, where belt replacement is time consuming and not conducive to sterilization and sanitization and at the same time can load the patient on to itself smoothly, safely and efficiently without causing injury or further damage to the patient and at the same time; safe and convenient to the hospital staff transferring the patients.

SUMMARY OF THE INVENTION

One of the objectives of the present invention is to provide a mechanism involved in patient transfer apparatus used for transferring invalid patients lying in supine position, from one horizontal surface to another horizontal surface, for e.g.—transferring patients from one bed to another bed, a bed to a stretcher, a bed to an operation theatre table, a bed to an x-ray unit and vice versa in a smooth and stress free manner without lifting the patient.

One of the objectives of the present invention is to provide a belt that can be easily removed and sterilized before another patient is put on especially for patients with infections.

One of the objectives of the present invention is to make the transfer less painful and cause less discomfort to the patient back and spine while the patient is loaded or unloaded.

One of the objectives of the present invention is to provide lighter yet having all advantages of the horizontal patient transfer system, so that the hospital staff can manually push it with less strain or less number of office staff are required to push the patient transfer gurney from one location to another location.

One of the objectives of the present invention is to provide a patient transfer gurney wherein the belts used can be quickly and easily replaced.

Another objective of the present invention is to provide the mechanism involved in patient transfer gurney more robust and less prone to breakdown and easier for maintenance.

Another objective of the present invention is to bring down the cost of manufacturing of the patient transfer gurney.

Another objective of the present invention is to ensure that the patient transfer gurney can easily be sterilized and sanitized and that the system includes least number of parts, joints, slits and gaps which are difficult to clean and having scope for bacteria can grow.

Another objective of the present invention is to provide a patient transfer gurney mechanism which does not have gears, chains, or components that require grease and lubrication and mechanisms which are not conducive to sanitization and sterilization process.

Advantages and features of the invention include but are not necessarily limited to that the mechanized system that moves, so that the patient remains stationary during loading, and that the system is easy and safe for the operator(s) and the patient. The system does not require lifting, or rolling the injured person onto the device for transferring According to one aspect of the present invention the mechanism used in patient transfer gurney system has a cantilevered stretcher design, mounted on a frame with four caster wheels and two pillars, wherein said cantilevered stretcher can go under the patient lying in supine position, and can position itself between the patient and the mattress without causing significant movement of the limbs, neck, chest and other parts of the body of the patient, thereby transferring the patient on to itself safety. There are two pillars mounted vertically on the frame with four caster wheels. The cantilevered stretcher is mounted on two pillars and it can travel vertically up and down on two linear bearings sliding on the two pillars. This up and down vertical motion is affected through two electric actuators. The stretcher up and down movement motion can be controlled by electric switches controlling the two electric actuators which work in tandem. After the stretcher positions the patient on to itself in a supine position, it can lift the patient clearly off the bed by moving vertically upwards. The entire patient transfer gurney can then be wheeled off to another location on the caster wheels.

Further, the cantilever stretcher includes a transfer belt mechanism, which has two flexible non endless belts (whose width is slightly less than the length of the stretcher and whose length is slightly longer than thrice the width of the stretcher) and two rollers on the side of the stretcher where it is mounted on two pillars. The ends of these two belts are attached on to the first roller. One belt (the upper belt) goes around the stretcher, the second belt (the lower belt) goes around the plate below the stretcher and the other ends of both these belts are attached on to second roller. When the first roller is rotated, both the belts wind around that roller and unwind from the second roller and vice versa. The lower portion of upper belt and the upper portion of the lower belt are in contact with each other and always move in the same direction and same speed. The upper portion of the upper belt moves over the stretcher in the direction of the two pillars taking the patient on to it without causing significant movement to the patient. The lower portion of the lower belt pulls itself towards the mattress (or the mattress towards itself). Both the belts working tandem in this manner makes the patient transfer efficient.

As described above, the non endless belt mechanism (arrangement of flexible non endless belts moving between the stretcher and plate in same directions, with upper flexible non endless belt going around the stretcher and lower belt going around the plate) can be implemented in three and four roller arrangement.

Additional features of the present invention will become apparent to those skilled in the art upon consideration of the following detailed description of an illustrated embodiment exemplifying the best mode of carrying out the invention as presently perceived.

BRIEF DESCRIPTION OF THE DRAWINGS

The advantages and features of the present invention will become better understood with reference to the following more detailed description and claims taken in conjunction with the accompanying drawings, in which like elements are identified with like part numbers.

DESCRIPTION OF THE PREFERRED EMBODIMENTS

Figure 1:
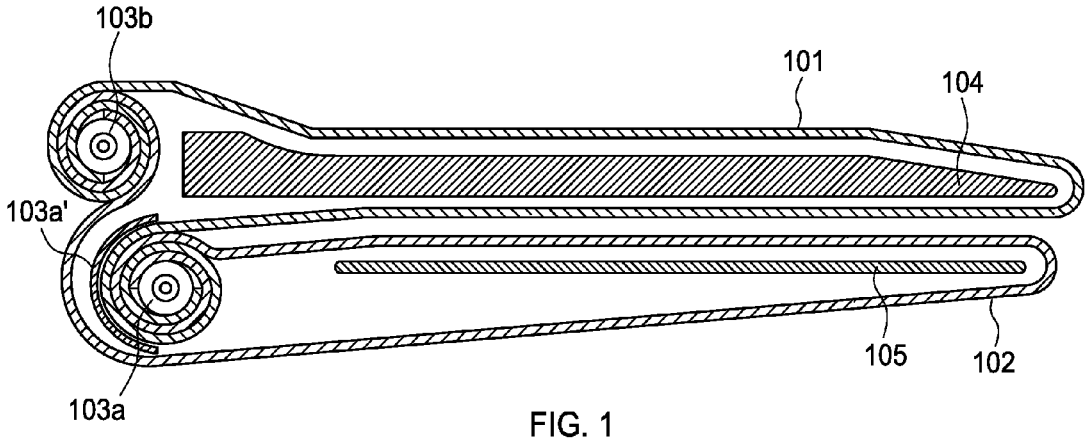
FIG. 1 is a side view of the two roller version of the embodiment of the present invention. In other words it is the two roller version of the Transfer Belt mechanism. This is the preferred embodiment of the present invention.

The best mode for carrying out the invention is presented in terms of its preferred embodiment, herein depicted within the FIG. 1

DETAILED DESCRIPTION OF THE INVENTION

Figure 1A:
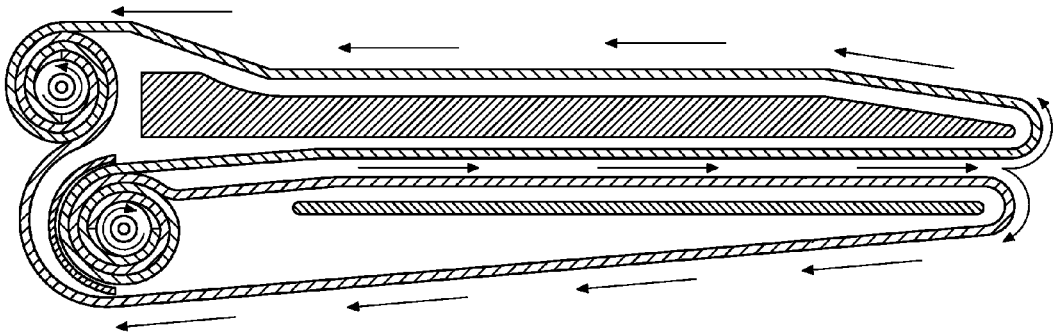
FIG. 1A depicts the direction of the two belts while loading the patient and FIG. 1B depicts the direction of the belt while unloading the patient.
Figure 1B:
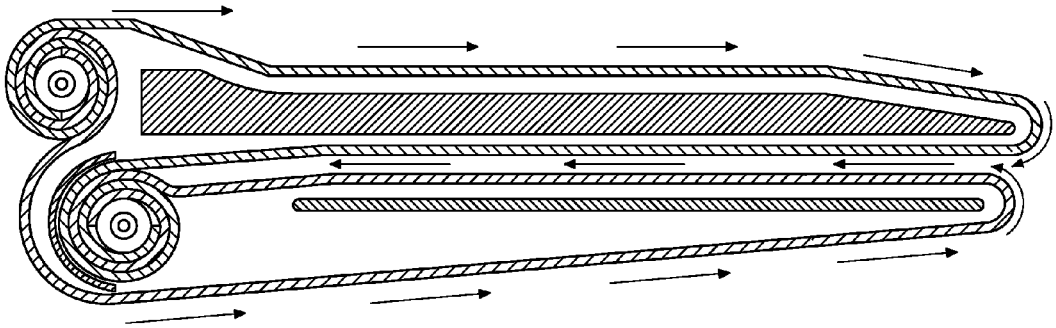

As shown in FIG. 1, the mechanism includes two flexible non endless belts attached to two rollers, according to the preferred embodiment. In the illustrated embodiment, two flexible non endless belts (101, 102) whose width is slightly less than the length of the stretcher and whose length is slightly longer than thrice the width of the stretcher, wherein said stretcher has two rollers (103*a*, 103*b*) on the side where it is mounted on two pillars (not shown in the FIG. 1). One end of first non endless belt 101 also referred as upper belt and one end of second non endless belt 102 referred as lower belt are attached on to roller 103*a*. The belt 101 or also referred as upper belt goes around the stretcher 104, the belt 102 or also referred as lower belt goes around the Plate 105 below the stretcher and the other ends of both these belts are attached on to roller 103*b*. Further, the mechanism comprises a friction reduction shield structure (103*a*$^1$) to avoid friction between the belt 101 and roller 103*a*. When the roller 103*a* is rotated, both the belts wind around that roller and unwind from the roller 103*b* and vice versa. The lower portion of the upper belt 101 and the upper portion of lower belt 102 are in contact with each other and always move in the same direction and same speed. The upper portion of the upper belt 101 which is above the stretcher moves in the direction of the two pillars taking the patient on to it without causing jerks or any significant relative movement to the patient. The lower portion of the lower belt 102 pulls itself towards the mattress (or the mattress toward itself). The direction of the two belts 101, 102 while loading and unloading of the patient is as depicted in FIGS. 1A and 1B. Both the belts working tandem in this manner makes the transfer more efficient. The belts are preferably constructed of a material which can be sterilized. The above described mechanism can be easily mounted by means of linear bearings on to the two pillars which are mounted on the frame with caster wheels, thereby forming the patient transfer gurney system for easy and more effective patient transfer.

Figure 2:
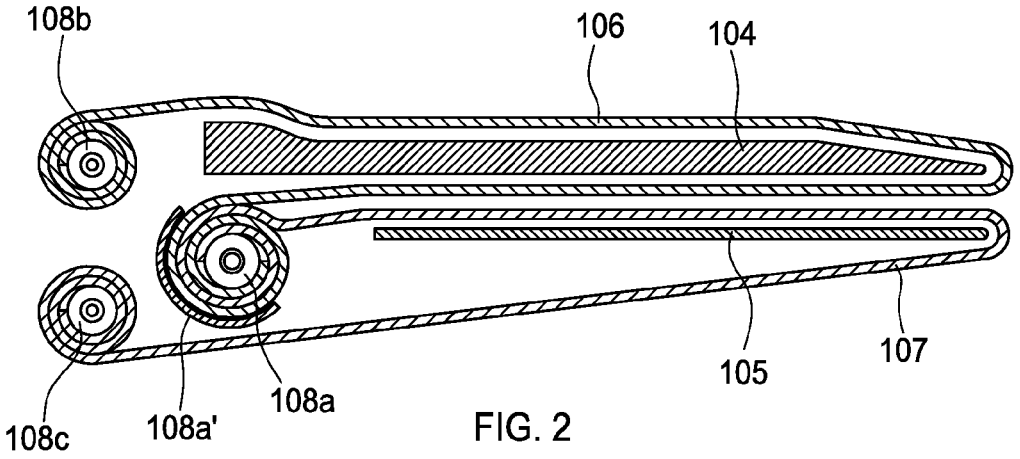
FIG. 2 is a side view of the three roller version of the embodiment of the present invention. In other words it is the three roller version of the Transfer Belt mechanism.
Figure 2A:
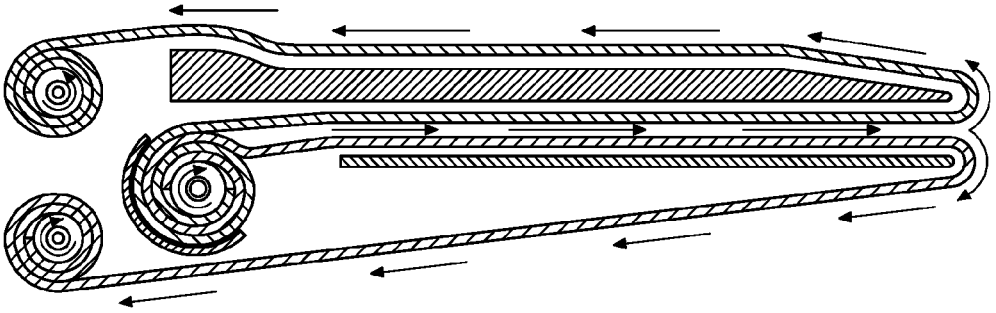
FIG. 2A depicts the direction of the two belts while loading the patient and FIG. 2B depicts the direction of the belt while unloading the patient.
Figure 2B:
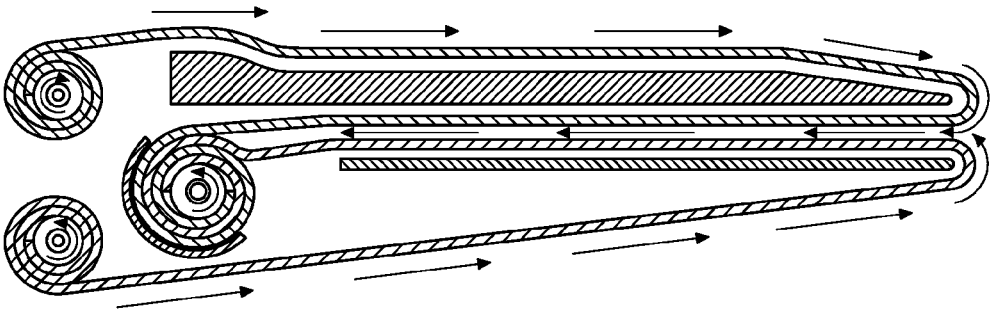

FIG. 2 is three roller version of the present invention. As shown in FIG. 2, the mechanism includes two flexible non endless belts attached to three rollers. In the illustrated embodiment as shown in FIG. 2, two flexible non endless belts (106, 107) whose width is slightly less than the length of the stretcher and whose length is slightly longer than thrice the width of the stretcher, wherein said stretcher has three rollers (108*a*, 108*b*, 108*c*) on the side where it is mounted on two pillars (not shown in the FIG. 2). One end of first non endless belt 106 and one end of second non endless belt 107 are attached to the first roller 108*a*. The first non endless belt 106 or also referred as upper belt goes around the stretcher 104, the second non endless belt 107 or also referred as lower belt goes around the Stainless steel tray 105 and the other end of the first non endless belt 106 is attached to second roller 108*b* and the second non endless belt 107 other end is attached to the third roller 108*c*. Further, the mechanism comprises a friction reduction shield structure (108*a*$^1$) attached to first roller 108*a* to avoid friction between the second non endless belt 107 and first roller 108*a* as shown in FIG. 2. The lower surface of one belt and the upper surface of other belt are in contact with each other and always move in the same direction and same speed. The direction of the two belts 106, 107 while loading and unloading of the patient is as depicted in FIGS. 2A and 2B. The above described mechanism can be easily mounted by means of linear bearings on to the two pillars which are mounted on the frame with caster wheels, thereby forming the patient transfer gurney system for easy and more effective patient transfer.

Figure 3:
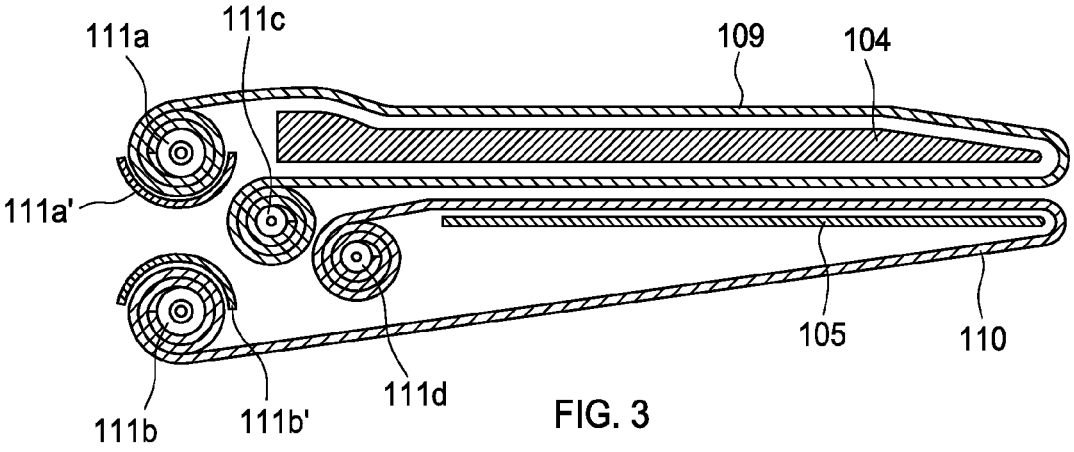
FIG. 3 is a side view of the four roller version of the embodiment of the present invention. In other words it is the four roller version of the Transfer Belt mechanism.
Figure 3A:
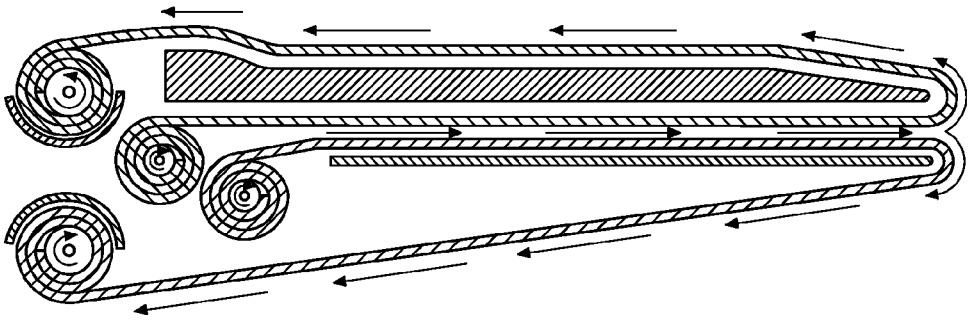
FIG. 3A depicts the direction of the two belts while loading the patient and FIG. 3B depicts the direction of the belt while unloading the patient.
Figure 3B:
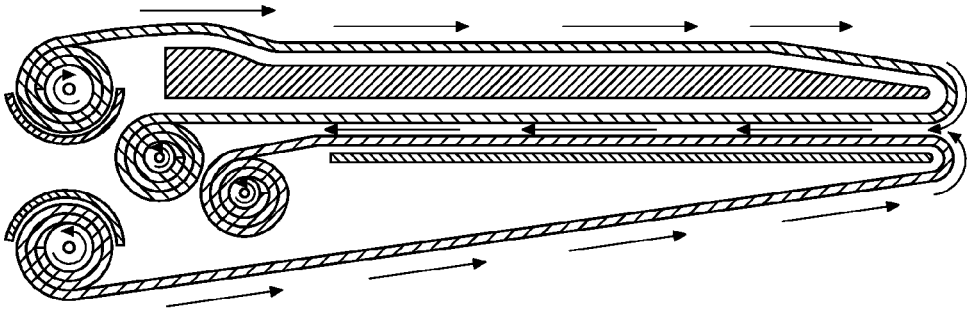

FIG. 3 is the four roller version of the invention. As shown in FIG. 3, the mechanism includes two flexible non endless belts attached to four rollers. In the illustrated embodiment as shown in FIG. 3, two flexible non endless belts (109, 110) whose width is slightly less than the length of the stretcher and whose length is slightly longer than thrice the width of the stretcher, wherein said stretcher has four rollers (111*a*, 111*b*, 111*c*, 111*d*) on the side where it is mounted on two pillars (not shown in FIG. 3). One end of first non endless belt 109 is attached to the first roller 111*a* and the other end of the first non endless belt 109 is attached to third roller 111*c*, One end of the second non endless belt 110 is attached to the second roller 111*b* and the other end is attached to the fourth roller 111*d*. The first non endless belt 109 or also referred as upper belt goes around the stretcher 104, the second non endless belt 107 or also referred as lower belt goes around the Stainless steel tray 105. The lower surface of one belt and the upper surface of other belt are in contact with each other and always move in the same direction and same speed. The direction of the two belts 109, 110 while loading and unloading of the patient is as depicted in FIGS. 3A and 3B. Further, the mechanism comprises a first friction reduction shield structure 111*a*$^1$ attached to first roller 111*a* to avoid friction between the first non endless belt 109 and the belt wound around other rollers and a second friction reduction shield structure 111*b*$^1$ attached to second roller 111*b* to avoid friction between the second non endless belt 110 and the belt wound around other rollers. The direction of the two belts 109, 110 while loading and unloading of the patient is as depicted in FIGS. 3A and 3B. The above described mechanism can be easily mounted by means of linear bearings on to the two pillars which are mounted on the frame with caster wheels, thereby forming the patient transfer gurney system for easy and more effective patient transfer.

Figure 4:
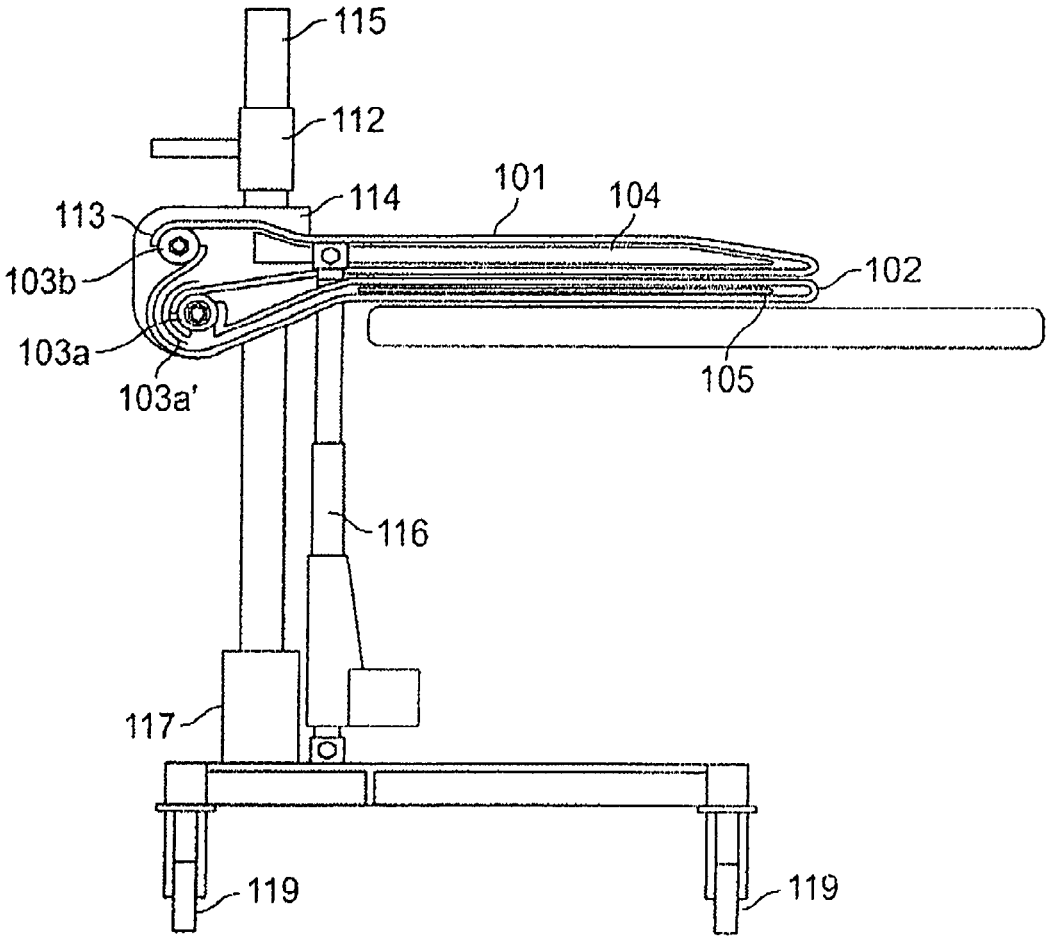
FIG. 4 is the side view of the patient transfer gurney system with the two roller version of the Transfer Belt Mechanism which is the preferred embodiment of the present invention.

As shown in FIG. 4, the Patient Transfer Gurney has a cantilever stretcher with the transfer belt mechanism. Using linear bearings, the cantilever stretcher with the transfer belt mechanism is mounted on the two pillars 115 which is fixed on the frame with four caster wheels 119. The electric actuators 116 shown in FIG. 4 can lift or lower the entire stretcher along with the transfer belt mechanism. The stretcher up and down movement motion can be controlled by electric switches (not shown in FIG. 4) controlling the two electric actuators which work in tandem. After the stretcher loads the patient on to itself in a supine position, it can lift the patient clearly off the bed by moving vertically upwards. The entire patient transfer gurney arrangement can then be wheeled off to another location on the caster wheels 119. The arrangement includes a support 117 for the pillars 115, friction reduction shield 103*a*$^1$, and further, the system includes a steel strip 113 for clamping and attaching the belt on to the rollers and a linear bearing case 114 and a side railing 112 for the safety of the patient. The cantilevered stretcher with the transfer belt mechanism has two flexible non endless belts (101, 102) and the two rollers 103*a* and 103*b*, the details of this transfer mechanism having been explained hereinbefore in connection with FIG. 1. The stretcher with the transfer belt mechanism is mounted upon the frame with the caster wheels 119 and the two pillars 115 via linear bearings disclosed within the linear bearing case 114.

Figure 5:
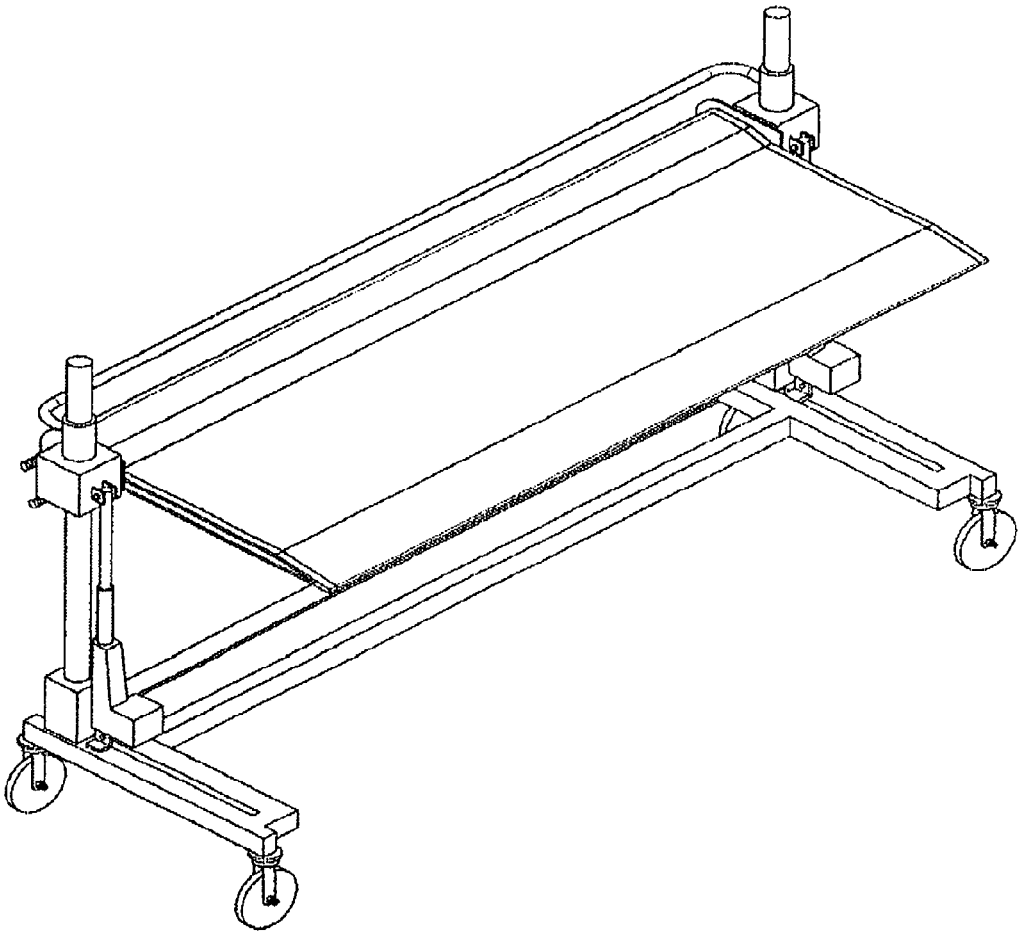
FIG. 5 is perspective view of the patient transfer gurney system with the two roller version of the Transfer Belt Mechanism which is the preferred embodiment of the present invention.

FIG. 5 is the three dimensional perspective view of the patient transfer system of FIG. 4.

A power drive (not shown) may optionally be provided for caster wheels, including speed control. The motor(s), linkages and power supply (rechargeable battery) may be stored within the lower interior portion of base, with controls mounted near handlebars.

Although the mechanism shown and described above is configured as a stretcher, it is within the purview of the invention that the device could be configured as a gurney, for example with legs. Additionally, although the mechanism shown and described for use with respect to an injured human being, they can be used for non-injured humans, injured or non-injured animals other than humans such as in a veterinary medical setting, and non-animal objects such as in a materials handling setting. The mechanism can also be used in to transfer the patients in different postures other than the supine position.

Thus, the mechanism of the present invention provides an effective way of transfer of patients. The present invention provides for the safe, fast and easy transfer of patients with many types of restrictions and helps reduce or eliminate the lifting of patients by hospital workers.

While the above description contains much specificity, these are not to be construed as limitations on the scope of the invention, but rather as one preferred embodiment thereof. Many variations are possible. For example, the present invention will be available in different sizes. In addition, the present invention could include a special footrest that can carry the legs of taller or heavier patients.

Equivalent elements can be substituted for the ones set forth above such that they perform in substantially the same manner in substantially the same way for achieving substantially the same result.

It is believed that the system and method of the present invention and many of its advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

The invention claimed is:

1. A transfer belt mechanism for loading a patient onto a transfer system, comprising:

a first non-endless belt having first and second opposite ends;

a second non-endless belt, separate from said first non-endless belt, having first and second opposite ends; and a roller mechanism;

wherein one of said first and second opposite ends of said first non-endless belt, and one of said first and second opposite ends of said second non-endless belt, are fixedly connected to said roller mechanism.

2. The transfer belt mechanism as set forth in claim 1, further comprising:

a second roller mechanism wherein a second one of said first and second opposite ends of said first non-endless belt, and a second one of said first and second opposite ends of said second non-endless belt, are fixedly connected to said second roller mechanism.

3. The transfer belt mechanism as set forth in claim 1, wherein:

said first non-endless belt is disposed around a stretcher; and said second non-endless belt is disposed around a support tray.

4. The transfer belt mechanism as set forth in claim 3, wherein:

said first non-endless belt, disposed around said stretcher, comprises an upper portion movable along an upper surface portion of said stretcher, and a lower portion movable along an undersurface portion of said stretcher; and said second non-endless belt, disposed around said support tray, comprises an upper portion movable along an upper surface portion of said support tray, and a lower portion movable along an undersurface portion of said support tray.

5. The transfer belt mechanism as set forth in claim 4, wherein:

said lower portion of said first non-endless belt is disposed in contact with said upper portion of said second non-endless belt.

6. The transfer belt mechanism as set forth in claim 5, wherein:

said lower portion of said first non-endless belt and said upper portion of said second non-endless belt are movable in the same direction.

7. The transfer belt mechanism as set forth in claim 3, wherein:

said first non-endless belt disposed around said stretcher is moved around an end portion of said stretcher in a counter-clockwise direction while said second non-endless belt disposed around said support tray is moved around an end portion of said support tray in a clockwise direction; and said first non-endless belt disposed around said stretcher is moved around said end portion of said stretcher in a clockwise direction while said second non-endless belt disposed around said support tray is moved around said end portion of said support tray in a counter-clockwise direction.

8. The transfer belt mechanism as set forth in claim 3, wherein:

said first and second non-endless belts are used in conjunction with a patient transfer system for transferring a patient from a bed onto said stretcher.

9. The transfer belt mechanism as set forth in claim 8, wherein:

said patient transfer system can transfer the patient from the bed to said stretcher when the patient is disposed in any one of several positions selected from the group comprising supine, prone, lying down on the bed on one side of the body, and seated on the bed.

10. The transfer belt mechanism as set forth in claim 9, wherein said patient transfer system comprises:

a patient transfer gurney.

11. The transfer belt mechanism as set forth in claim 10, wherein said patient transfer gurney comprises:

a pair of spaced pillars upon which said transfer belt mechanism, comprising said stretcher and said first and second non-endless transfer belts, are movably mounted in a cantilevered manner for movement in vertically upward and downward directions; and electric actuators operatively connected to said transfer belt mechanism for moving said transfer belt mechanism in said vertically upward and downward directions relative to said pair of spaced pillars of said patient transfer gurney.

12. The transfer belt mechanism as set forth in claim 1, wherein:

said first non-endless belt and said second non-endless belt are moved at the same speed.

13. The transfer belt mechanism as set forth in claim 1, wherein:

said roller mechanism is motorized.

14. The transfer belt mechanism as set forth in claim 1, further comprising:

a second roller mechanism wherein a second one of said first and second opposite ends of said first non-endless belt is fixedly connected to said second roller mechanism; and a third roller mechanism wherein a second one of said first and second opposite ends of said second non-endless belt is fixedly connected to said third roller mechanism.

15. The transfer belt mechanism as set forth in claim 1, wherein:

said roller mechanism comprises a pair of rollers wherein one of said first and second opposite ends of said first non-endless belt is fixedly connected to a first one of said pair of rollers, and one of said first and second opposite ends of said second non-endless belt is fixedly connected to a second one of said pair of rollers.

16. The transfer belt mechanism as set forth in claim 15, wherein:

a second one of said first and second opposite ends of said first non-endless belt is fixedly connected to a third roller, and a second one of said first and second opposite ends of said second non-endless belt is fixedly connected to a fourth roller.

* * * * *